US005289775A

United States Patent [19]

Spiegel et al.

[11] Patent Number: 5,289,775

[45] Date of Patent: Mar. 1, 1994

[54] DEVICE FOR POSITIONING A MAGAZINE FOR AUTOMATICALLY CHANGING PRINTING PLATES

[75] Inventors: Nikolaus Spiegel, Walldorf; Hans-Georg Jahn, Wiesenbach; Hermann Beisel, Walldorf; Helmut F. Jäger, Königsbach-Stein; Wolfgang Pfizenmaier, Neckargemünd; Peter T. Blaser, Dielheim; Andreas Geider, St. Leon-Rot; Walter Hofheinz, Heidelberg, all of Fed. Rep. of Germany

[73] Assignee: Heidelberger Druckmaschinen AG, Heidelberg, Fed. Rep. of Germany

[21] Appl. No.: 938,900

[22] Filed: Aug. 31, 1992

[30] Foreign Application Priority Data

Aug. 31, 1991 [DE] Fed. Rep. of Germany ..... 4129021
Jul. 28, 1992 [DE] Fed. Rep. of Germany ..... 4224832

[51] Int. Cl.[5] ..... B41F 27/12; B41L 29/14

[52] U.S. Cl. ..... 101/477; 198/408; 271/106

[58] Field of Search ..... 101/477, 415.1, DIG. 36, 101/216, 217, 141, 142, 375, 376, 174, 152, 153; 198/408, 409; 271/3, 4, 10, 18

[56] References Cited

U.S. PATENT DOCUMENTS

| | | | |
|---|---|---|---|
| 4,727,807 | 3/1988 | Suzuki et al. | 101/415.1 |
| 4,874,077 | 10/1989 | Yaguchi et al. | 198/408 |
| 5,074,212 | 12/1991 | Kobler et al. | 101/477 |
| 5,176,081 | 1/1993 | Buus | 271/106 |
| 5,188,027 | 2/1993 | Fantoni | 101/216 |

FOREIGN PATENT DOCUMENTS

| | | |
|---|---|---|
| 0431715 | 6/1991 | European Pat. Off. . |
| 61-248834 | 11/1986 | Japan . |
| 62-174157 | 7/1987 | Japan . |
| 62-221541 | 9/1987 | Japan . |

*Primary Examiner*—Eugene H. Eickholt
*Attorney, Agent, or Firm*—Herbert L. Lerner; Laurence A. Greenberg

[57] ABSTRACT

A device for movably positioning in a plurality of positions a magazine for automatically changing printing plates in a printing machine for changing the printing plate of the plate cylinder, replacing the printing plates of the magazine, servicing the printing machine and normal operation, includes a device for mounting the magazine, including a vertical guide wherein the magazine is displaceable, and a horizontal shaft about which the magazine is swivelable, and drive devices for displacing and swiveling the magazine.

19 Claims, 6 Drawing Sheets

DEVICE FOR POSITIONING A MAGAZINE FOR AUTOMATICALLY CHANGING PRINTING PLATES

The invention relates to a device for positioning a magazine for automatically changing printing plates, the magazine being movable into a plurality of positions which permit changing the printing plate of the plate cylinder, replacement of the printing plates of the magazine, machine servicing and normal operation, respectively.

In the course of automating many operations on a printing machine which had to be performed manually by the pressman heretofore, magazines have been developed which hold old and new printing plates, supply the plate cylinder with new printing plates and accept old printing plates. A problem arises, in this regard, that such magazines have to be fitted to existing printing presses, virtually all of which have a relatively narrow space available for this purpose between the individual printing units.

Heretofore known from Japanese Published Document Sho 61-248834 is a device of the foregoing general type in which the magazine is swivelable into three positions by means of an angularly formed lever. In order to replenish and remove the printing plates in the magazine, the magazine can be brought into a ready position between the printing units. For normal operation of the printing machine, the lever swivels the magazine over the printing unit so that the magazine hovers in a substantially horizontal position above the printing unit held by the lever. In order to change the plate, the lever swings downwardly and the magazine folds into an inclined position with the end of the magazine at the plate cylinder. Due to the position of the lever as well as of the rotary shaft of the magazine required for changing plates, the magazine is, when in its ready or setting-up position, in the space between the printing units. This means that the replenishment and removal of the printing plates of the magazine can be performed only from the side, because the space between the printing units is no longer accessible. The replacement of the plates in the cassette thus becomes problematical for large-size presses. Due to the positioning of the magazine above the printing unit in the normal-operation position, it is not possible for the plates in the magazine to be replaced during printing. Held by the levers, the magazines hover above the printing units during printing and, as a result thereof, they are susceptible to vibrations, they screen off or block the illumination required for working on the printing units and, with respect to design or construction, they do not fit into the overall printing machine. It is necessary to provide a protective guard for the printing units, the protective guard required for reasons of industrial safety having to be removed from the printing unit in order to effect the change of plates.

It is accordingly an object of the invention to provide a device for positioning a magazine for automatically changing printing plates which demands as little space as possible to be taken up thereby between the printing units and permits the magazine to fit inconspicuously into the overall printing machines during printing.

With the foregoing and other objects in view, there is provided, in accordance with the invention, a device for movably positioning in a plurality of positions a magazine for automatically changing printing plates in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine.

In accordance with another feature of the invention, the magazine is mounted in a printing unit of the printing machine having an inking unit and, in a normal-operation position, covers as a protective guard a delivery side of the printing unit while leaving an upper side of the inking unit accessible.

Apart from avoiding the disadvantages of the heretofore known prior art, the advantages of the invention are that, during normal operation of the printing machine, the cassette closely hugs the printing unit, and access to the inking unit is assured. The printer is able readily to perform the operations on the ink duct, the coating roller, the duct roller and the vibrator roller. Because the magazine is firmly connected to the printing unit over a large area, no sensitivity whatsoever exists with regard to vibrations. Of particular advantage is the construction wherein, in normal operation, the magazine serves as a protective guard for the printing unit, because, in this manner, it is possible to economize on an actual protective guard and there is no need to remove the actual protective guard for automatically changing plates. A manual operating step and an additional device for ensuring automatic removal of an actual protective guard for the printing unit are no longer required.

In accordance with a further feature of the invention, the magazine has means for replacing the printing plates thereon from above. It is possible, in this manner, during the operation of the printing press, to remove the old printing plates from the magazine and to insert new printing plates into the magazine. This results in a reduction in the set-up or make-ready time required between the printing jobs.

In accordance with an added feature of the invention, the magazine is displaced so far upwardly into a servicing position that the printing unit is accessible for all servicing operations. It is possible, in this manner, by means of an operator command, to establish a condition in which the printer has complete access to the inking unit, the plate cylinder and the rubber-blanket cylinder as well as the other parts of the printing unit. It is also possible for the rollers to be removed from the printing unit. There is virtually no activity within the framework of printing-press maintenance that requires the complete removal of the magazine.

In accordance with an additional feature of the invention, there is provided a locking device which locks the vertical adjustability of the magazine in the servicing position, and accordingly serves as additional protection for a person carrying out such servicing operations.

In accordance with yet another feature of the invention, the plate cylinder has a plate clamping and tensioning apparatus, and the magazine is movable by the displacing and swiveling means into a plate-changing position extending substantially tangentially to the plate cylinder, the printing plates, in the plate-changing position, being insertable into and removable from the plate clamping and tensioning apparatus of the plate cylinder. This advantageously locks the vertical adjustability of the magazine in the plate-changing position, also by means of the locking device, and in accordance with yet a further feature of the invention.

In accordance with yet an added feature of the invention, the vertical guide comprises respective fixed rails vertically disposed at opposite sides of the magazine, and respective displaceable vertical rails running in the fixed rails, the horizontal shaft being held in the respective displaceable rails on the opposite sides of the magazine, and includes locking means for locking the shaft in a vertical position of the magazine. Such locking means ensure a reliable mounting of the magazine, which is of advantage particularly in the case of pneumatic drives, because the ability to carry out the positioning is maintained even if there is a failure of the compressed-air supply.

As a construction of the drive for the vertical adjustment, in accordance with yet an additional feature of the invention, a lifting cylinder is disposed on the opposite sides of the magazine, the lifting cylinder being connected to the displaceable rail and being supported on a support structure of the printing machine, the lifting cylinder having a length corresponding to at least the distance between the normal-operation position and the servicing position of the magazine.

In accordance with still another feature of the invention, a swiveling cylinder is suspended at one end thereof from one of the displaceable rails, and a lever is firmly connected to the shaft and has a connection with the other end of the swiveling cylinder.

Trouble-free positioning of the magazine in the plate-changing position can be achieved, in accordance with still a further feature of the invention, when the plate cylinder has a Schmitz ring at respective ends thereof, and the magazine comprises two rollers each located opposite the respective Schmitz ring at the ends of the plate cylinder, the rollers, in the plate-changing position, being in running contact with the Schmitz rings.

In accordance with still an added feature of the invention, the magazine is mounted in a printing unit of the printing machine, and locking means are included comprising a first stop affixed to the shaft and, in a vertical position of the magazine, being in contact with a second stop affixed to the displaceable rail for preventing an upper side of the magazine from tilting in a direction towards the printing unit, a swivelable lever formed with a latch and mounted on the displaceable rail, the swivelable lever being in contact the first stop, and a locking cylinder secured to the displaceable rail and connected to the swivelable lever for bringing the swivelable lever with the latch into and out of engagement.

In accordance with still an additional feature of the invention, the vertical guide comprises respective fixed rails vertically disposed at opposite sides of the magazine, and respective displaceable vertical rails running in the fixed rails, and locking means are included comprising a swivelable latch mounted on a fixed part in an uppermost region of the fixed rail and formed with a bevel as well as a recess, detents carried by the displaceable rail and engageable with the bevel for swiveling the swivelable latch, spring means engageable with the latch for yieldingly opposing the swiveling thereof until the detents have traversed the bevel and are received in the recess, stop means engageable by the swivelable latch, the spring means biasing the swivelable latch into engagement with the stop means, and an unlatching cylinder having a stop for the detents and having means engageable with the swivelable latch for unlatching the latch and for simultaneously bringing the stop for the detents into and out of engagement therewith.

In accordance with another feature of the invention, one of the detents is disposed at a lower end of the displaceable rail and serves for vertically locking the magazine in the servicing position.

In accordance with a further feature of the invention, one of the detents is disposed at a location of the displaceable rail opposite to the locking means, in the plate-changing position.

In accordance with other features of the invention, the lifting cylinder, the tilting cylinder, the locking cylinder and the unlatching cylinder are pneumatic cylinders. This makes a simple construction of the drives possible. Use can be made of the compressed air existing within the printing press and, unlike the use of hydraulics, no damage can occur as a result of leaks in the lines.

In accordance with an added feature of the invention, respective vertically extending fixed racks are disposed at opposite sides of the magazine, respective gears are connected by a connecting shaft and runningly engage in the racks, and bearing means for the connecting shaft are provided on the magazine.

In accordance with a concomitant feature of the invention, the racks are connected to the fixed rails.

Other features which are considered as characteristic for the invention are set forth in the appended claims.

Although the invention is illustrated and described herein as embodied in a device for positioning a magazine for automatically changing printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary side elevational view of a printing unit provided with a device for positioning a magazine for automatically exchanging of printing plates, according to the invention, as viewed from the delivery side;

FIG. 1*a* is an enlarged fragmentary view of FIG. 1 showing a locking device of the invention in greater detail;

Figure 1:
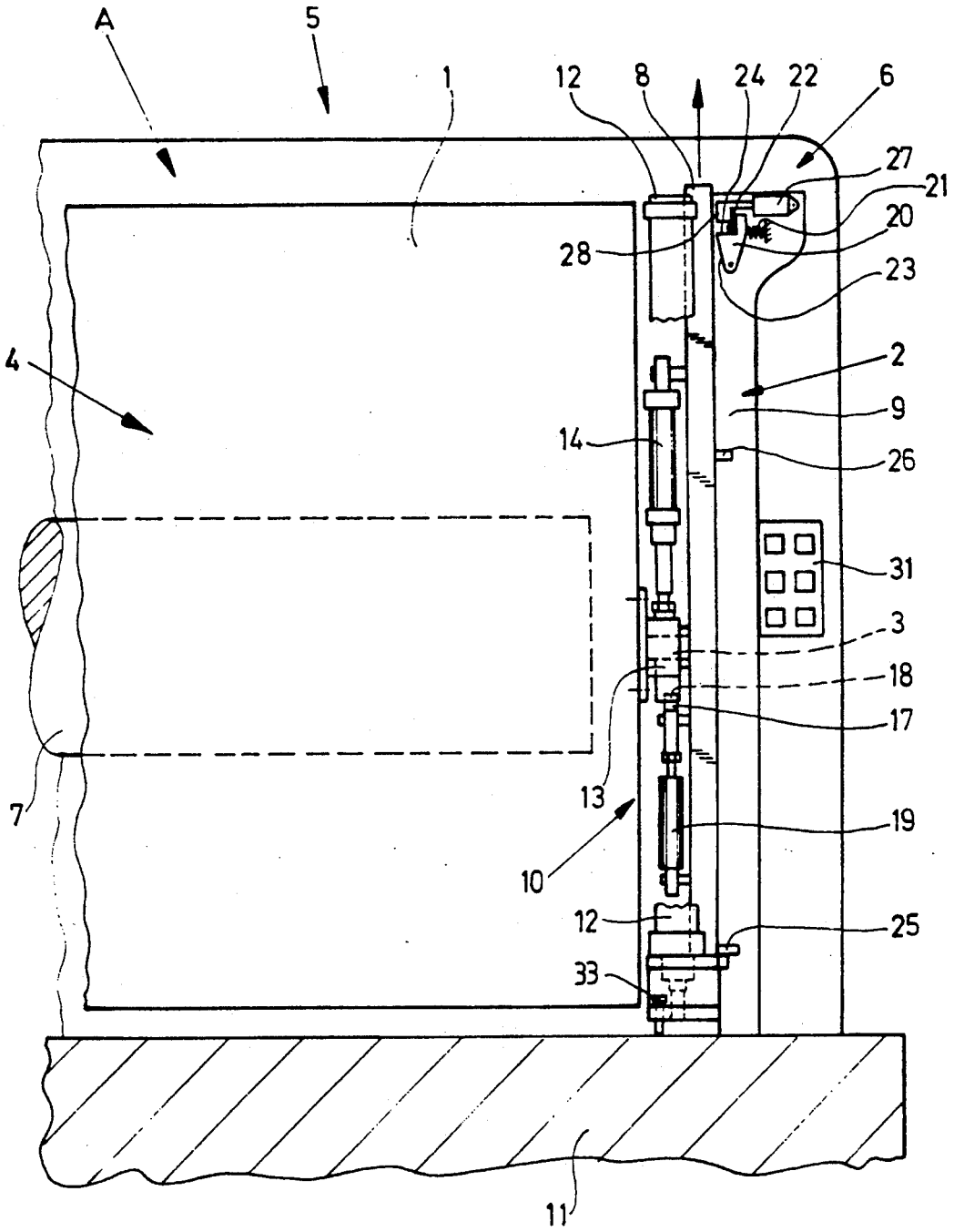
Figure 3:
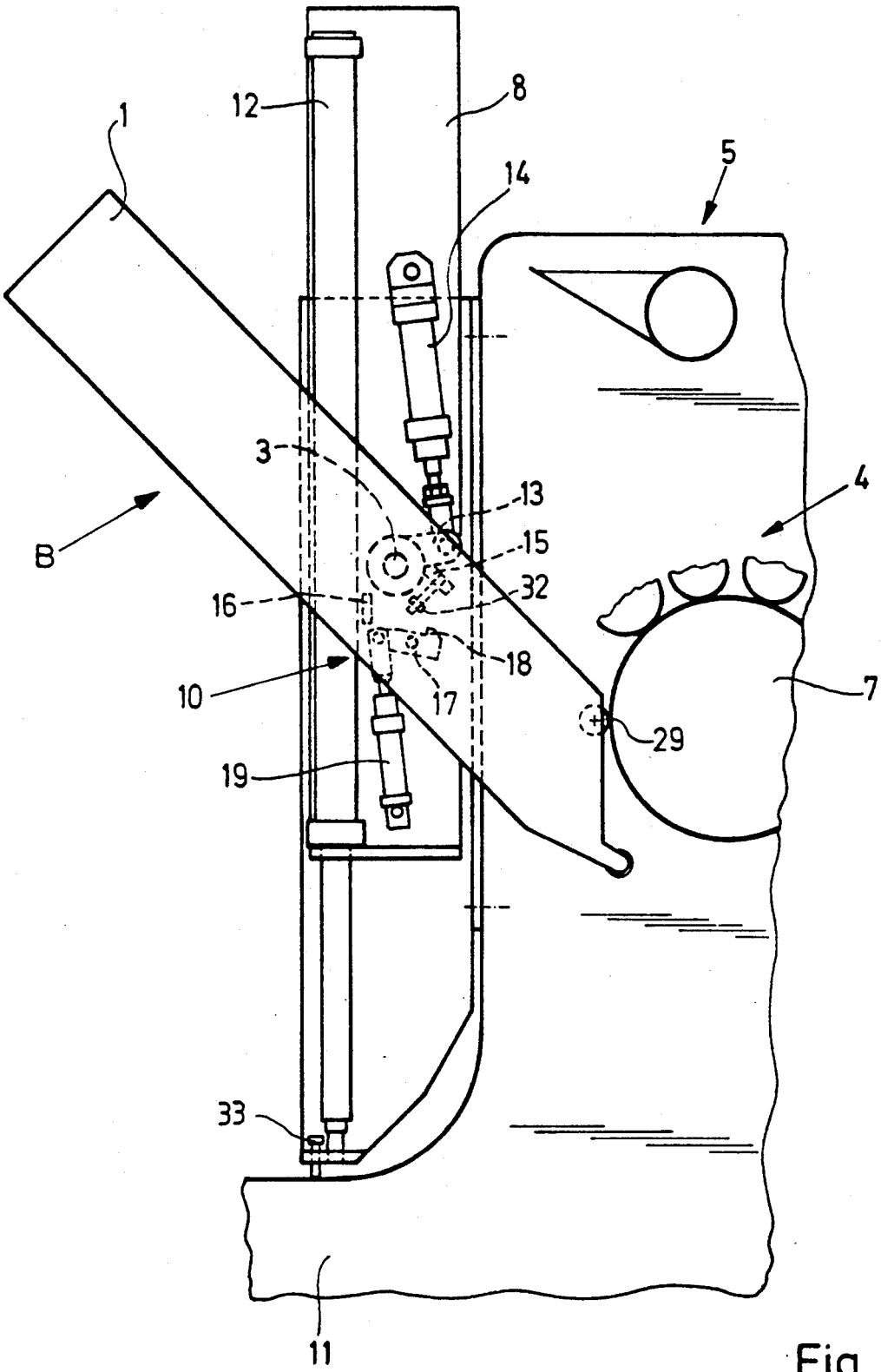
FIG. 3 is a view like that of FIG. 2, but showing the assembly in a plate-changing phase.

Referring now to the drawings and, first, particularly to FIG. 1 thereof, there is shown a fragmentary elevational view of a printing unit, as seen from the delivery side, assembled with a device for positioning a magazine 1 for automatically changing printing plates, constructed in accordance with the invention. The magazine 1 is suspended in a vertical guide 2 by means of a shaft 3. The vertical guide 2 is formed of a fixed rail 9 and a displaceable rail 8 supported in the fixed rail 9. The shaft 3 is inserted into the displaceable rail 8. The fixed rail 9 and the displaceable rail 8 are of such length that the magazine 1 can be displaced from a normal-operation position A shown in FIG. 1 to a servicing position C shown in FIG. 4 wherein the magazine 1 is shifted upwardly so far that servicing personnel have access to all parts of a printing unit 4 for performing servicing operations thereon. Such adjustment of the magazine 1 is effected by a lifting cylinder 12, which has a length corresponding to this adjustment travel path. The lifting cylinder 12 is connected to the displaceable rail 8. The lifting cylinder 12 is supported at the underside thereof on a base 11 of a printing press which includes the printing unit 4. An adjusting screw 33 serves for precisely positioning the lifting cylinder 12. A tilting cylinder 14 serves to bring the magazine 1 into a plate-changing position B, as shown in FIG. 3. Further provided is a locking cylinder 19 which ensures that the magazine 1 is locked in the vertical position thereof and may be swiveled about the shaft 3 by means of the tilting cylinder 14 only in order to bring the magazine 1 into the plate-changing position B (FIG. 3).

Because it is expedient to lock the vertical adjustment system of the magazine 1, a suitable locking device 6 with an unlatching cylinder 27 is provided. Such a locking arrangement is necessary in the servicing position C (FIG. 4) in order to ensure reliably that, when work is being performed, the magazine 1 remains in this position even if there is a failure of the lifting cylinder 12. In this manner, an interruption in the compressed-air supply cannot cause any movement of the magazine 1 out of the servicing position C. Such a locking arrangement is necessary for the plate-changing position B in order to achieve precise positioning, which ought also not to be adversely affected by disruptions of the compressed-air supply. In order to achieve a locking of the magazine 1 in the servicing position C, the displaceable rail 8 is provided with a first detent 25 at a lower end thereof, as shown in FIG. 1. In a middle region of the rail 8, a second detent 26 serves for locking the system in the plate-changing position B (FIG. 3). The second detent 26 is located so that, after latching in the position B and after subsequent swiveling of the magazine 1, the latter assumes a precise plate-changing position at a non-illustrated conventional plate clamping and tensioning apparatus of the plate cylinder 7.

Figure 1A:
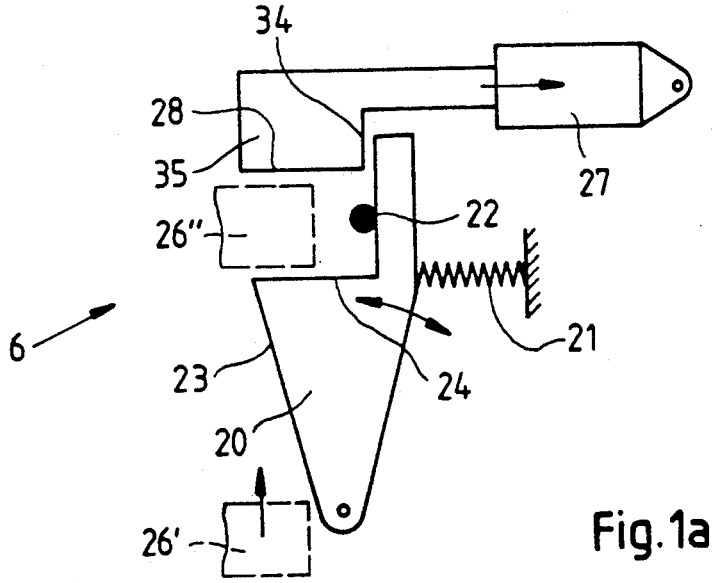

FIG. 1*a* shows on an enlarged scale how a locking device 6 is attached in an upper region of the fixed rail 9. A latch 20 is disposed on the fixed rail 9 and is formed with a bevel 23 which cooperates with the detents 25 and 26 in a manner that the latch 20 is swiveled about a bearing point against the force of a spring 21 until the corresponding detent 25, 26 has run over the bevel 23 and latches into a recess 24. This process is illustrated by the showing of the second detent 26 in broken lines in the position 26', in which it runs against the bevel 23, and in the position 26'', in which it is locked between the recess 24 formed between the latch 20 and an upper stop 28. The swiveling of the latch 20 in a direction towards the displaceable rail 8 is limited by a stop 22. Unlatching is effected by an unlatching cylinder 27, which has an adjustable part 35 formed with a shoulder 24 for pulling the latch 20 back. The adjustable part 35 of the unlatching cylinder 27 is further formed with the upper stop 28 which limits the upward displacement of the detents 25 and 26, but which can also be brought out of engagement by the unlatching cylinder 27 when the latch 20 is pulled back, an action which is necessary in order to release the detent 26 and to latch the detent 25.

Because only one side of the printing unit 4 is shown, it must nevertheless be realized that the aforedescribed devices are provided expediently on both sides of the magazine 1 and that the positioning and locking devices on both sides of the magazine 1 cooperate in synchronism. It is necessary, in any event, for the tilting cylinder 14 and the lifting cylinder 12, as well as the locking device 6, to be present on both sides of the magazine 1. This is not absolutely necessary, however, with regard to the locking apparatus 10, which locks the vertical alignment system of the magazine 1. Also visible in FIG. 1 is a control desk or panel 31 of the printing unit 4, which must not be hidden or obstructed by the devices.

Figure 2:
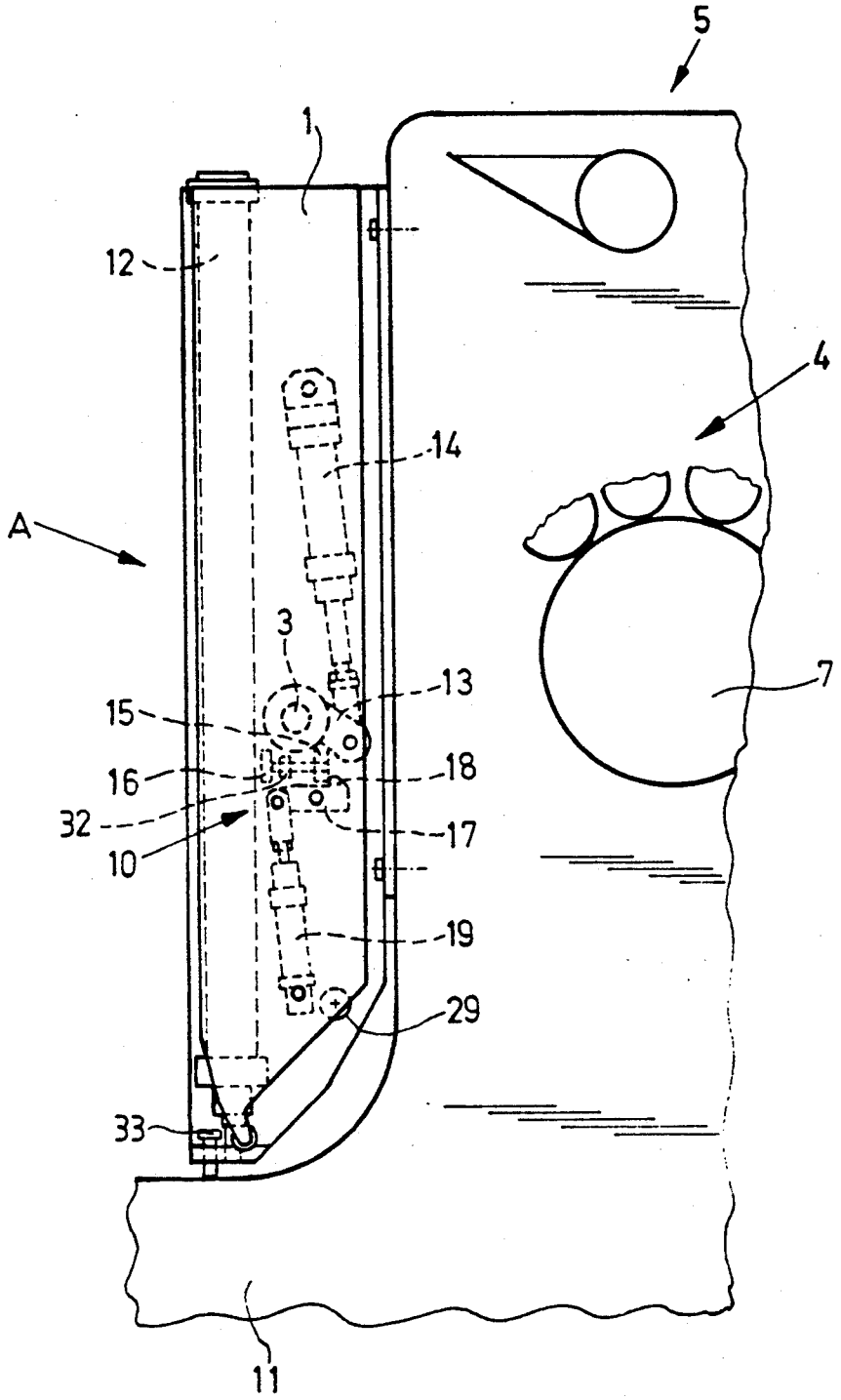
FIG. 2 is a fragmentary elevational view of FIG. 1 as seen from the right-hand side of the latter, showing the device and the printing unit in a normal operating phase.

FIG. 2 is a side elevational view of the printing unit 4 with the magazine 1 according to the invention. This view omits the vertical guide 2 shown in FIG. 1 and situated between the viewer and the plane of FIG. 2, together with the displaceable rail 8, the fixed rail 9 and the locking device 6 with its individual parts. Such elements are also located behind the plane of the drawing of FIG. 2 on the other side of the magazine 1. The parts are identical on both sides of the magazine 1, with the exception of the locking apparatus 10, which may be disposed also only on one side of the magazine 1.

The tilting cylinder 14 serves to swivel the magazine 1 into the plate-changing position B, as shown in FIG. 3. In addition to the tilting cylinder 14, which is attached by its upper end to the displaceable rail 8, the tilting apparatus includes a lever 13, which is firmly connected to the shaft 3 of the magazine 1 and has an articulated connection with the piston rod of the tilting cylinder 14. In the position A, the piston rod of the tilting cylinder 14 is extended, and the magazine 1 thereby assumes a vertical position, as is required for the position A of normal operation and the position C for servicing. When the piston of the tilting cylinder 14 draws the piston rod back, the magazine 1 swivels into the plate-changing position B, as is shown in FIG. 3.

Figure 4:
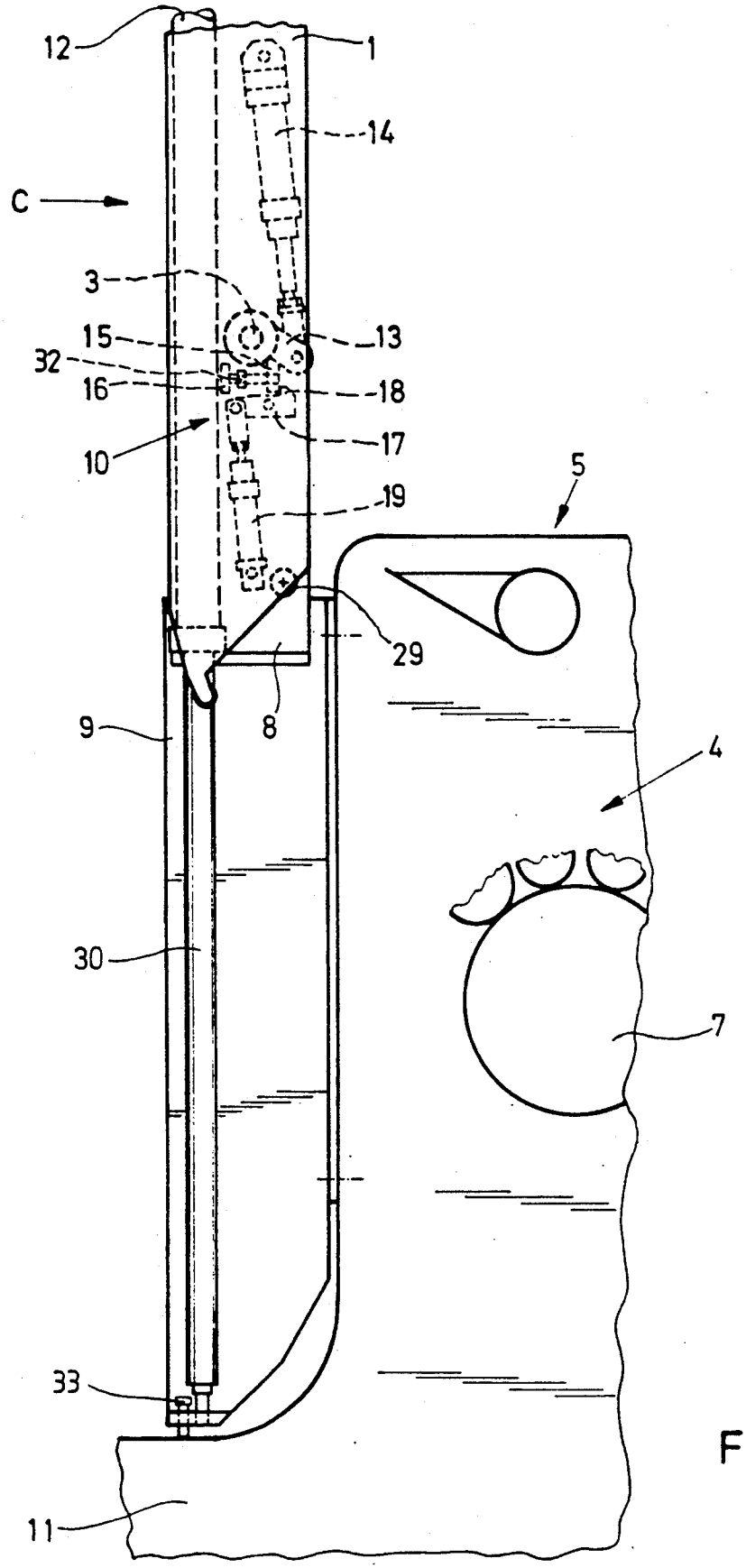
FIG. 4 is another view like that of FIGS. 2 and 3 but showing the assembly in a servicing phase.

For the normal-operation position A, as is shown in FIG. 2, and also for the servicing position C, as shown in FIG. 4, it is necessary to lock the magazine 1 in its vertical alignment position. This is accomplished by the locking apparatus 10, which includes a first stop 15 which is firmly connected to the shaft 3 and, in the position shown, is in contact with a second stop 16 which is connected to the displaceable rail 8 (not shown in FIG. 2). The stop 15 can be set by means of a set-screw 32 to ensure a precisely vertical position of the magazine 1. With the magazine 1 in the vertical position shown in FIG. 2, the first stop 15 is held by a latch 18, which can be unlatched by means of an articulating lever 17. The articulating or pivot point of the lever 17 is also connected to the displaceable rail 8. The lever 18 is actuated by a locking cylinder 19, which is suspended by its lower end from the displaceable rail 8.

It is evident from the views of FIG. 2, as well as of FIG. 1, that the magazine 1, when in the normal-operation position A, covers the printing unit 4 on the delivery side. In this manner, the magazine 1 serves as a protective guard for the printing unit 4, so that a separate protective guard for the printing unit is no longer necessary. This not only dispenses with the need for any other protective guard, but, also, there is no need for a protective guard to be removed in order to bring the magazine 1 into the plate-changing position B.

It is apparent from FIG. 2 that the magazine 1, when in normal-operation position A, does not impede access to the inking unit 5. Accordingly, with the printing unit in normal operation, the pressman is readily able to gain access to the ink duct, the coating roller, the duct roller, the vibrator roller or other elements of the inking unit 5. All operations which may be required during printing can be performed without any obstruction whatsoever.

FIG. 3 is a view like that of FIG. 2, except that the magazine 1 is in the plate-changing position B. In this view all parts bearing the same reference characters are identical with the similarly identified parts shown in FIG. 1 and FIG. 2.

With reference to FIGS. 1 to 3, hereinafter is a description of the operation of the device according to the invention as the magazine 1 is brought into the plate-changing position B:

In order to bring the magazine 1 into the plate-changing position B, the lifting cylinder 12 initially becomes operative and pushes the displaceable rail 8 with the magazine 1 upwardly until the second detent 26 is caught and held fast in the locking device 6. Then, the locking apparatus 10 stops operating, in that the locking cylinder 19 swivels the lever 17, releasing the first stop 15 and, thereafter the tilting cylinder 14, through the intermediary of the lever 13, swivels the magazine 1 about the shaft 3 until the magazine 1 assumes the plate-changing position B. A reliable attainment of the plate-changing position B is achieved by the magazine 1 due to its being provided with two rollers 29, which are located opposite the Schmitz rings or cylinder bearers of the plate cylinder 7 and, upon attainment of the plate-changing position B, come into contact with the Schmitz rings or cylinder bearers. In the position B, it is possible for a used printing plate to be removed from the plate cylinder 7 by providing that the non-illustrated conventional plate clamping and tensioning apparatus releases the printing plate at one of the ends thereof, so that the printing plate can be inserted into the magazine 1 and can be gripped there and drawn in, respectively. Then a new printing plate is fed out of the magazine 1, inserted into the clamping and tensioning apparatus, and wound around the plate cylinder 7. The end of the printing plate is inserted with a non-illustrated pressure roller into the clamping and tensioning apparatus, where it is clamped and tensioned. The positioning of the magazine 1 is maintained during these operations, so that the magazine 1 is held in vertical position by the locking device 6 and in the oblique or inclined position by the rollers 29 running on the Schmitz rings or cylinder bearers.

The return to the normal-operation position A takes place by the tilting cylinder 14 again transporting the magazine 1 into the vertical position thereof wherein the magazine 1 is locked in place by the locking apparatus 10 due to the swiveling by the locking cylinder 19 of the lever 17 again and, consequently, the first stop 15 being held between the second stop 16 and the latch 18. Thereafter, the lifting cylinder 12 comes into action and lowers the magazine 1 by means of the displaceable rail 8 until the normal-operation position A, shown in FIGS. 1 and 2, is again attained.

FIG. 4 shows the magazine 1 in the servicing position C. Once again, all parts identified by the same reference characters are identical with corresponding parts illustrated and described heretofore. In order to bring the magazine 1 into the servicing position C, the lifting cylinder 12 is actuated until all of the parts of the printing unit 4 have been made accessible for servicing operations. When the servicing position C is reached, the first detent 25 is locked in the aforedescribed manner by the locking device 6. This ensures the maintenance of the magazine 1 in the servicing position C even if there should be a failure in the actuating medium of the lifting cylinder 12. When the magazine 1 is being moved into the servicing position C, as well as when it remains in that position, the locking apparatus 10 maintains its locking position in order to lock the magazine 1 reliably in the vertical position. As shown in FIG. 4, the locking apparatus 10, as well as the tilting cylinder 14, together with the parts which cooperate therewith are displaced upwardly with the displaceable rail 8, because they are connected to the latter. As in FIGS. 2 and 3, the displaceable rail 8 and the fixed rail 9, which are situated in front of the magazine 1, are omitted in FIG. 4 for reasons of clarity. In the position shown in FIG. 4, the piston rod 30 of the lifting cylinder 12 is visible and must be of a length corresponding to that of the adjustment travel.

Figure 5:
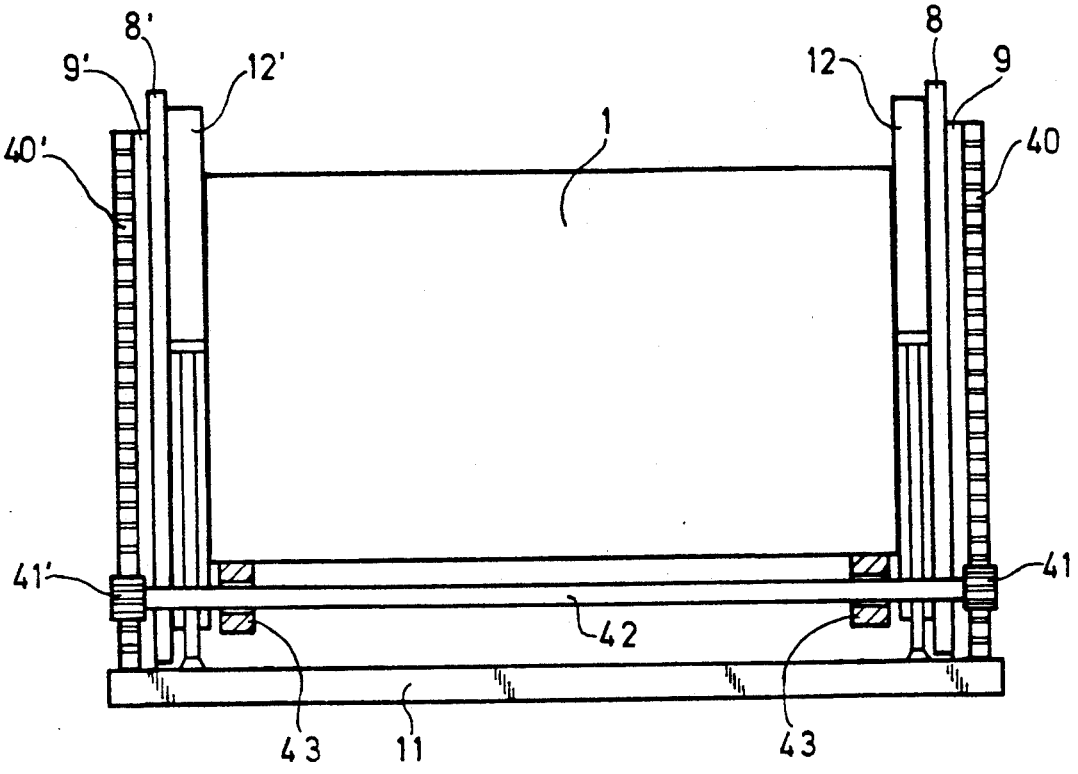
FIG. 5 is an elevational view showing another construction of the vertical adjustment system.

FIG. 5 shows an advantageous construction of the vertical adjustment system of the magazine 1 for effecting synchronous operation. For this purpose, fixed vertically-extending racks 40 and 40' are disposed on both sides of the magazine 1. Gears 41 and 41' which are connected to one another by a connecting shaft 42 run in the racks 40 and 40'. Via a bearing 43, preferably having two bearing points, the connecting shaft 42 is connected to the magazine 1. In an advantageous arrangement, the racks 40 and 40' are fastened to the fixed rails 9 and 9' or to a support or foundation which also carries the fixed rails 9 and 9'.

This improvement ensures that the vertical adjustment system of the magazine 1 will operate synchronously, free of jolts and smoothly. Of course, other synchronizing devices are also conceivable, for example, guides provided on both sides and being supported by chains or toothed belts.

We claim:

1. Device for movably positioning in a plurality of positions a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine, the magazine being mounted in a printing unit of the printing machine having an inking unit and, in a normal-operation position, covering as a protective guard a delivery side of the printing unit while leaving an upper side of the inking unit accessible.

2. Device for movably positioning in a plurality of positions a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine, the magazine having means for replacing the printing plates thereon from above.

3. Device for movably positioning in a plurality of positions a magazine for automatically changing printing plates mounted in a plate cylinder in a printing machine having a printing unit for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, drive means for displacing and swiveling the magazine, and means for displacing the magazine so far upwardly into a servicing position that the printing unit is accessible for all servicing operations.

4. Device according to claim 3, including locking means for locking the magazine against vertical displacement and in the machine servicing position.

5. Device according to claim 4, wherein said vertical guide comprises respective fixed rails vertically disposed at opposite sides of the magazine, and respective displaceable vertical rails running in said fixed rails, and including locking means comprising a swivelable latch mounted on a fixed part in an uppermost region of one of said fixed rails and formed with a bevel as well as a recess, detents carried by at least one of said displaceable rails and engageable with said bevel for swiveling said swivelable latch, spring means engageable with said latch for yieldingly opposing the swiveling thereof until said detents have traversed said bevel and are received in said recess, stop means engageable by said swivelable latch, said spring means biasing said swivelable latch into engagement with said stop means, and a unlatching cylinder having a stop for said detents and having means engageable with said swivelable latch for unlatching said latch and for simultaneously bringing said stop for said detents into and out of engagement therewith.

6. Device according to claim 5, wherein one of said detents is disposed at a lower end of one of said displaceable rails and serves for vertically locking the magazine in said servicing position.

7. Device according to claim 6, wherein on of said detents is disposed at a location of one of said the displaceable rails opposite to said locking means, in said plate-changing position.

8. Device according to claim 5, wherein said unlatching cylinder is a pneumatic cylinder.

9. Device for movably positioning in a plurality of positions a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine, wherein the plate cylinder having a plate clamping and tensioning apparatus, and the magazine being movable by said displacing and swiveling means into a plate-changing position extending substantially tangentially to the plate cylinder, the printing plates, in said plate-changing position, being insertable into and removable from the plate clamping and tensioning apparatus of the plate cylinder, and including locking means for locking the magazine against vertical displacement and in the plate-changing position.

10. Device for movably positioning in a plurality of positions a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine, said vertical guide comprising respective fixed rails vertically disposed at opposite sides of the magazine, and respective displaceable vertical rails running in said fixed rails, said horizontal shaft being held in the respective displaceable rails on the opposite sides of the magazine, and including locking means for locking said shaft in a vertical position of the magazine.

11. Device according to claim 10, including a lifting cylinder disposed on the opposite sides of the magazine, said lifting cylinder being connected to one of said displaceable rails and being supported on a support structure of the printing machine, said lifting cylinder having a length corresponding to at least the distance between the normal-operation position and the servicing position of the magazine.

12. Device according to claim 10, including a swiveling cylinder suspended at one end thereof from one of said displaceable rails, a lever firmly connected to the shaft and having a connection with the other end of said swiveling cylinder.

13. Device according to claim 10, wherein the magazine is mounted in a printing unit of the printing machine, and including locking means comprising a first stop affixed to said shaft and, in a vertical position of the magazine, being in contact with a second stop affixed to one of displaceable rails for preventing an upper side of the magazine from tilting in a direction towards the printing unit, a swivelable lever formed with a latch and mounted on one of said displaceable rails, said swivelable lever being in contact with said first stop, and a locking cylinder secured to one of said displaceable rails and connected to said swivelable lever for bringing said swivelable lever with said latch into and out of engagement.

14. Device according to claim 11, wherein said lifting cylinder is a pneumatic cylinder.

15. Device according to claim 12, wherein said swiveling cylinder is a pneumatic cylinder.

16. Device according to claim 13, wherein said locking cylinder is a pneumatic cylinder.

17. Device for movably positioning in a plurality of positions of a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, and drive means for displacing and swiveling the magazine, the plate cylinder having a Schmitz ring at respective ends thereof, and the magazine comprising two rollers each located opposite the respective Schmitz ring at the ends of the plate cylinder, said rollers, in the plate-changing positions, being in running contact with the Schmitz ring.

18. Device for movably positioning in a plurality of positions a magazine for automatically changing printing plates mounted on a plate cylinder in a printing machine for changing the printing plate of the plate cylinder, replacing the printing plates of the magazine, servicing the printing machine and normal operation, comprising means for mounting the magazine, including a vertical guide wherein the magazine is displaceable, and a horizontal shaft about which the magazine is swivelable, drive means for displacing and swiveling the magazine, and respective vertically extending fixed racks disposed at opposite sides of the magazine, respective gears connected by a connecting shaft and runningly engaging in said racks, and bearing means on the magazine for said connecting shaft.

19. Device according to claim 18, wherein said racks are connected to said fixed rails.

* * * * *